United States Patent [19]

Yamamoto

[11] Patent Number: 4,729,314

[45] Date of Patent: Mar. 8, 1988

[54] STAMP ADAPTER FOR CONNECTION IN A SERIES

[76] Inventor: Takanobu Yamamoto, 1183-2, Asahicho, Nabarishi, Mieken, Japan

[21] Appl. No.: 13,430

[22] Filed: Feb. 11, 1987

[51] Int. Cl.[4] ..... B41M 1/02

[52] U.S. Cl. ..... 101/398; 101/368

[58] Field of Search ..... 101/398, 399, 373, 396, 101/400, 405, 368, 401.2, 401.5; 40/328; 276/1; 446/117, 125

[56] References Cited

U.S. PATENT DOCUMENTS

| | | | |
|---|---|---|---|
| 635,651 | 10/1899 | Campfield | 101/398 |
| 3,506,749 | 4/1970 | Weissman | 101/368 |
| 3,832,947 | 9/1974 | Funahashi | 101/327 |
| 3,885,495 | 5/1975 | Funahashi et al. | 101/327 |
| 3,952,653 | 4/1976 | McFarland | 101/368 |
| 3,955,499 | 5/1976 | Funahashi et al. | 101/111 |

FOREIGN PATENT DOCUMENTS

| | | | |
|---|---|---|---|
| 2425875 | 12/1979 | France | 446/125 |

*Primary Examiner*—Edgar S. Burr
*Assistant Examiner*—J. Lisehora
*Attorney, Agent, or Firm*—Barnes & Thornburg

[57] ABSTRACT

A stamp adapted for connection in a series, the stamp comprising a handle having a rubber letter or figure overlaid to a non-porous first rubber layer and a second porous rubber layer; and the handle having a first tenon and a first mortise on one side, and a second tenon and a second mortise on the opposite side, the first tenon being adapted to fit in the second mortise and the second tenon being adapted to fit in the first mortise.

4 Claims, 13 Drawing Figures

PRIOR ART

PRIOR ART

STAMP ADAPTER FOR CONNECTION IN A SERIES

BACKGROUND OF THE INVENTION

1. Field of the Invention

The present invention relates to a stamp having a handle and a rubber letter (figure) on the top end of the handle, and more particularly to a stamp connectable in a series so as to print a series of letters or figures.

2. Description of the Prior Art

To connect one stamp to another so as to achieve a series of letters or figures, a problem is involved in aligning the letters or figures on the different stamps. To solve this problem there have been many proposals, among which is a stamp disclosed in Japanese Utility Model Publication (examined) No. 54(1979)-5054. This stamp has a lengthwise groove or narrow width on one side and a lengthwise projection on the other side so that the projection in one stamp fits in the groove of another to form a unity. The united stamps are covered with a cap so as to secure the unit thereof.

This prior art stamp secures a firm unity of unit stamps, and avoid misalignment of the letters (or figures). However the connection of unit stamps requires a lot of labor, and a cap is additionally required, which leads to the increased cost.

To solve the problem pointed out above another proposal is made, which will be described by reference to FIG. 11:

The illustrated stamp 1 has a handle 2 which has a lengthwise recess 10 of relatively large size on one side 2*a* and a lengthwise projection 11 on the opposite side 2*b*, the projection being insertable in the recess 10. When the projection 11 is fitted in the recess 10, the two stamps 1 are connected side by side to form a series of figures, such as 12 or 56. When three stamps are united in this way, the resulting figure will be a three-digit figure, such as 123 or 568. The relatively large size of recess and projection secures a firm connection of the stamps with less possibility of misalignment.

A further proposal is disclosed in Japanese Utility Model Publication (unexamined) No. 53(1978)-34317. This is a modified version of the above-mentioned prior art stamp, and is provided with several recesses 10 and projections 11 on the respective sides.

The prior art illustrated in FIG. 11 dispenses with the use of a cap for securing the unity of the stamps connected together. This is an advantage in saving labor and cost. Nevertheless the exact alignment is difficult, and requires skill and experiment. Once the recess and projections have been fitted it is difficult to disassemble the connected stamps for re-adjustment or subsequent use. In addition, the relatively large recess and projection require a large space on the handle, thereby resulting in the increased size of the stamp. A pocket-size stamp allows of no space for the large recess and projection, and it is more difficult to produce them on such a limited space. When the recess and projection are of reduced sizes it becomes difficult to fit them, and after they are fitted the connection is likely to become loose.

The prior art stamp disclosed in the Japanese Utility Model Publication (unexamined) No. 53(1978)-34317 referred to above has solved this problem to some extent by providing several recesses and projections on the handle, but the fitting labor is multiplied for the increased number of them. In addition, the production of precise recesses and projections is difficult. This prior art method is only applicable to a relatively large size of stamp.

In connecting two or more stamps the problem is how to align the faces of letters or figures. If misalignment occurs some of the print is clear but the others are likely to be unclear. This problem is partly due to the loose connection of the stamps, and partly due to the uneven thickness of cushion 20 (FIG. 12). In general a rubber piece having a letter or figure is fixed to the handle 2 through a sponge 20 having a thickness of about 0.7 mm. However the sponge has uneven thickness in itself in a range of 0.5 to 1.3 mm. Such uneven thickness is unavoidably caused in the process of production. When a stamp is singly used no problem arises at all but when two or more stamps are used as a connected unity the misalignment of letter (or figure) faces is fatal to the print. The cushion 20 is jointed to the handle and the rubber 4 with an adhesive; the reference numerals 21 and 22 denote the adhesive layers, which means that two operational steps are required. This leads to the increased production cost.

Another problem involved in achieving series of stamps is the difficulty of ink absorption in the non-porous rubber pieces. To solve this problem the rubber is made of a porous rubber material which is capable of storing ink in the hollows (pores) defined in the porous material of the rubber. However porous rubber is supple and easily compressed against the paper, thereby squeezing the stored ink in excess. To prevent this problem the stamp is provided with any device for stopping an excessive force from applying to the handle. However it is difficult to provide stamps of the present invention with such devices. In addition, any aid must be furnished to the stamp for making up for the supple porous structure, which usually has a porosity of 60 to 90%.

OBJECTS AND SUMMARY OF THE INVENTION

The present invention is directed to solve the problems pointed out with respect to the prior art stamps, and is to provide an improved stamp connectable one after another for achieving a series of letters of figures.

Other objects and advantages of the present invention will become more apparent from the following description when taken in conjunction with the accompanying drawings which shows, for the purpose of illustration only, one embodiment in accordance with the present invention.

According to the present invention there is provided a stamp adapted for connecting in a series, the stamp comprising:

a handle having a rubber letter or figure overlaid to a non-porous first rubber layer and a second porous rubber layer; and the handle having a first tenon and a first mortise on one side, and a second tenon and a second mortise on the opposite side, the stamp having a plurality of handles wherein a first tenon on a handle being adapted to fit in the second mortise on another handle and the second tenon on a handle being adapted to fit in the first mortise on another handle.

DETAILED DESCRIPTION OF THE INVENTION

Figure 1:
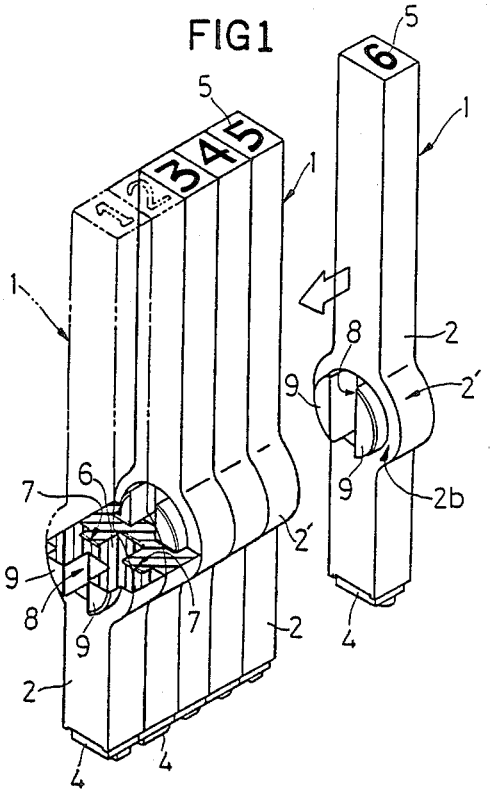
FIG. 1 is a perspective view showing a stamp embodying the present invention, particularly to show several stamps connected in series.

Referring to FIGS. 1 to 7 the stamp is generally denoted by the reference numeral 1, hereinafter referred to as "unit stamp". The unit stamp 1 is made up of a handle 2 of plastics having a rectangular cross-section, and a rubber piece 4 jointed to the handle 2 with an adhesive 3. The handle 2 has a letter (figure) 5 on its top end face for identification.

Figure 3:
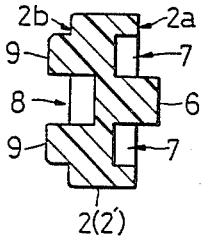
FIG. 3 is a fragmentary cross-section particularly showing the tenon and mortise shown in FIGS. 1 and 2.
Figure 5:
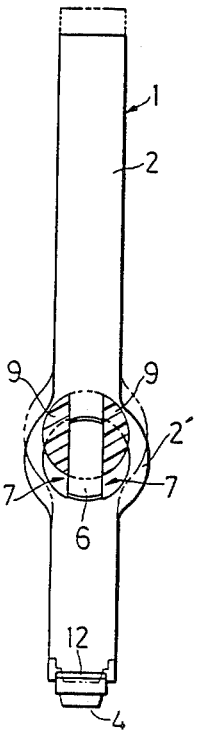
FIG. 5 is a cross-section taken along the line A—A in FIG. 4.

The handle 2 has flat surfaces 2*a* and 2*b* on opposite sides, and bulged portions 2' on each of the other opposite sides. Because of the bulged portions 2' the sides 2*a* and 2*b* have widened portions. The side 2*a* has mortises 7 in which a first tenon 6 projects from the bottom of the mortise 7 beyond the surface of the side 2*a* as best shown in FIG. 3. The side 2*b* has second tenons 9 in pair with a second mortise 8 interlocated therebetween. The second tenons 9 also project beyond the surface of the side 2*b*.

Figure 4:
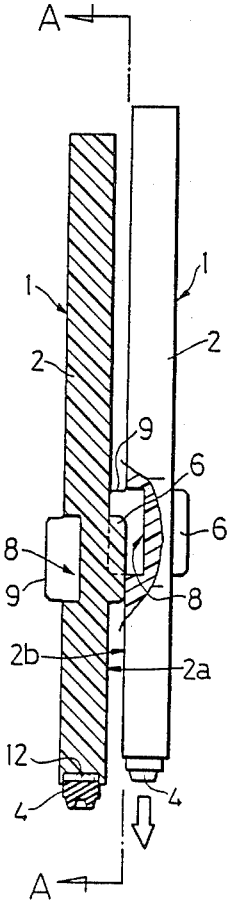
FIG. 4 is a partly cross-sectional view showing the connection of two stamps.
Figure 12:
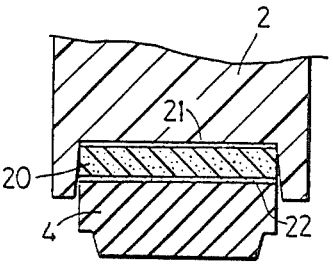
FIG. 12 is a diagrammatic cross-section showing the internal structure of the prior art stamp shown in FIG. 11.

In connecting two unit stamps 1 together the sides 2*a* and 2*b* are lightly met as shown in FIG. 4 with the first tenon 6 shallowly fitting in the first mortise 8. At this stage the unit stamp having the first tenon 6 is allowed to move in the mortise 8 in a vertical direction. During a vertical slight movement of one of the unit stamps the second tenons 9 are fitted in the first mortises 7. When the letters (or figures) 4 are exactly aligned the two unit stamps 1 are strongly pressed to each other so as to secure the firm connection thereof.

Figure 6:
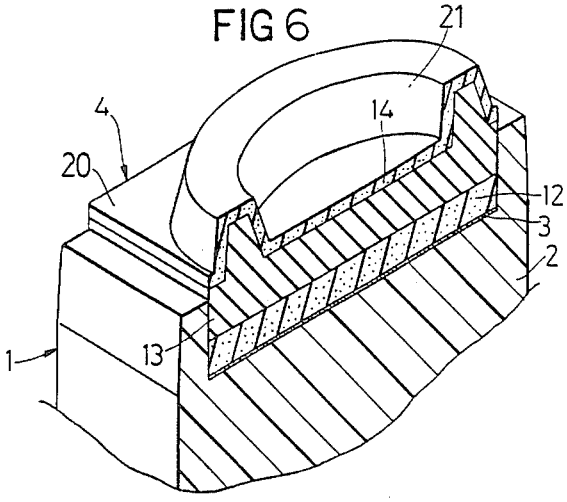
FIG. 6 is a perspective cross-sectional view, partly omitted, showing the internal structure of the stamp.

Referring to FIG. 6 the rubber letter 4 includes a base plate 20, a die portion 21 (letter or figure) projecting therefrom and a cushion 12 of porous rubber, the reference numeral 3 denoting an adhesive layer.

It is important to adjust the thickness of the cushion 12; when it is excessively thick, it becomes too soft to provide a base for the letter 4 to be impressed against the paper, whereas when it is excessively thin it will not function as a cushion. The optimum range of thickness is ½ to 1/7, preferably ⅓ to 1/5, of that of the rubber 4. In a preferred embodiment the rubber 4 was 3 mm thick, and the cushion 12 was 0.7 mm thick.

Referring to FIG. 6 the base plate 20 and die portion 21 are made of a thin porous rubber layer 14 laid on a non-porous rubber base layer 13 having a hardness of 52° to 68°, which is lined with the cushion 12. In a preferred embodiment the porous layer 14 is 0.05 to 0.5 mm thick, and the porosity of it and of the cushion 12 is 60 to 80%, preferably 70%, which is almost equal to that of sponge in ordinary use.

Figure 7A:
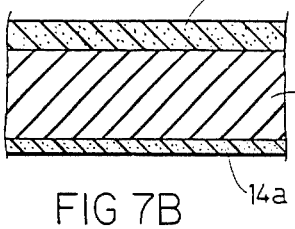
FIGS. 7*a* and 7*b* are a diagrammatic view explaining the process of fabrication of the rubber letter.
Figure 7B:
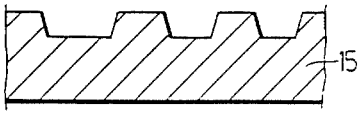

FIGS. 7*a* and 7*b* diagrammatically show the structure of the rubber 4. There is provided a core layer 13*a* of non-vulcanized rubber, which is coated with a first layer 14*a* of non-vulcanized rubber in which a substance of high solubility, such as sodium chlorate, and a solvent, such as toluene, are added. In addition, the core layer 13*a* is lined with a second layer 12*a*. The layers 12*a*, 13*a* and 14*a* are soluble with each other. Preferably they are made of the same material; for example, acrylic nitro butadiene rubber (NBR) is used. However ordinary rubbers can be effectively used.

The material prepared in this way is placed in a mold 15 made of phenol resin with the first layer 14*a* on the top, and the layers 12*a*, 13*a* and 14*a* are simultanelusly vulcanized under pressure. The die portion (letter) 21 is produced. Finally the substance of solubility contained in the layers 12*a* and 14*a* is removed, and the finish mass is cut to a desired size into the rubber letter 4.

In this way the core layer 13*a* constitutes a foundation 13 of non-porous rubber, and the first layer 14*a* constitutes a second base 14 of porous rubber, and the second layer 12*a* constitutes the cushion 12 of porous rubber, wherein they are integrally overlaid as shown in FIG. 6.

When the layers 12*a*, 13*a* and 14*a* are simultaneously molded under vulcanization, it is essential to avoid their admixing with each other. Particularly the first layer 14*a* of high fluidity is likely to flow on the core layer 13*a*, which causes uneven surface on the second base 14, and where there is a thin portion the foundation 13 is likely to brake it and project therethrough until it is exposed outside. In order to avoid this problem after the core layer 13*a* and second layer 12*a* are vulcanized in the mold 15, the surface of it is coated with the first layer 14*a*. Then the molded mass is placed in another mold of the same shape, and is vulcanized again, from which the substance of solubility is extracted and removed.

The rubber letter 4 is jointed to the top end of the handle 2. According to the present invention the surfacial unevenness resulting from the molding is limited to 0.05 mm or below. For example, when the cushion 12 has a thickness of 0.7 mm it can absorb a height of up to 0.2 mm on the surface of the rubber 4. This ensures that several unit stamps 1 can be effectively connected one after another so as to achieve the clear impression of a series of letters or figures.

The die projection 21 has a thickness of about 1.0 mm, and is supported on the porous layer 14 having a thickness of 0.05 mm to 0.5 mm, which is insufficient to impart softness to the die portion. This eliminates the necessity of fabricating the whole die portion 21 with porous rubber, which means that the die portions keeps its rigidity.

Figure 8:
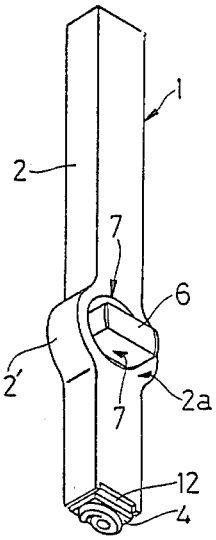
FIG. 8 is a perspective view showing a modified version of the stamp.

FIG. 8 shows a modified version of the embodiment, characterized in that the tenon 6 is horizontally produced and the mortises 7 are provided above and below the tenon 6. Accordingly the opposite side has a horizontal morties 8 and horizontal tenon 9 (not shown).

Figure 9:
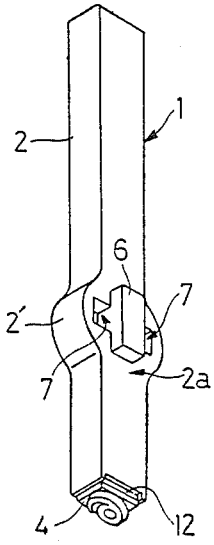
FIG. 9 is a perspective view showing another modified version of the stamp.
Figure 11:
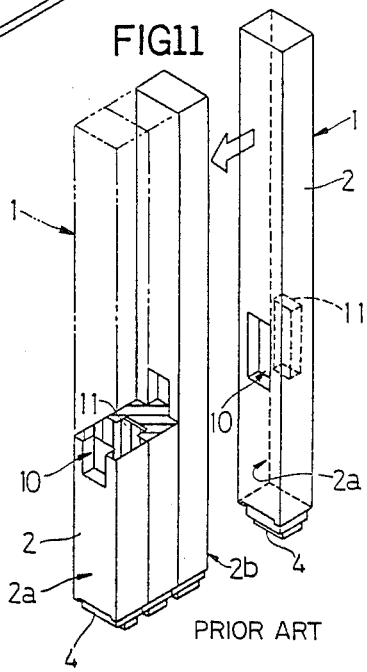
FIG. 11 is a perspective view showing prior art stamps connected in a series.

FIG. 9 shows a further modified version, characterized by rectangular mortises 7 instead of the semi-circular ones shown in the first- and second-mentioned examples. Though not shown, the mating tenons 9 have a corresponding rectangular shape.

Figure 2:
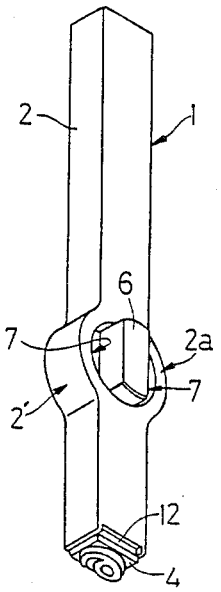
FIG. 2 is a perspective view showing a unit stamp.
Figure 10:
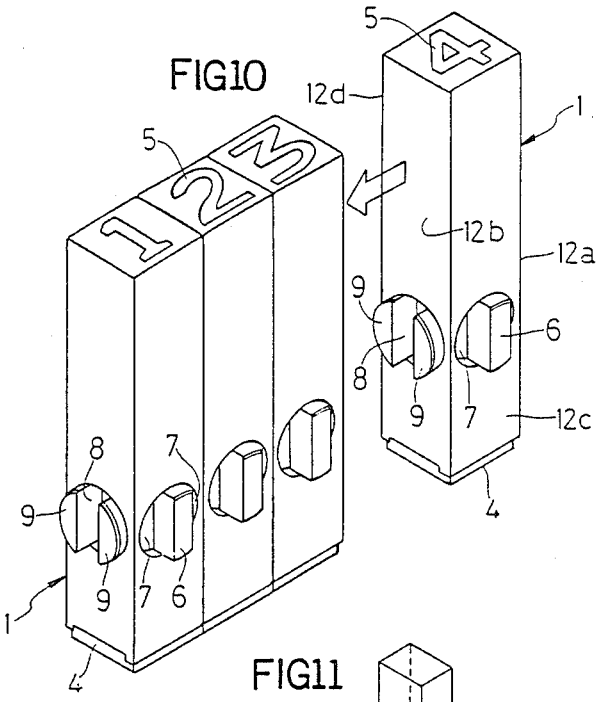
FIG. 10 is a perspective view showing a further modified version of the stamp.

FIG. 10 shows a still further modified version, characterized by a relatively large handle having no widened portion but having a square cross-section throughout its entire length. In addition, the tenons and mortise shown in FIG. 2 are provided on all the sides 12*a*, 12*b*, 12*c* and 12*d* of the handle.

What is claimed is:

1. A stamp adapted for connection in a series, the stamp comprising:

a plurality of handle means with each handle means having a rubber letter or figure overlaid to a non-porous first rubber layer and second porous rubber layer of 0.05 to 0.5 mm thickness; and with each handle means having a first tenon means and a plurality of first mortise means on one side of the handle means and a plurality of second tenon means and a second mortise means on the opposite side of the handle means, the first tenon means of one handle means being adapted to fit in the second mortise means of an adjacent handle means and the second plurality of tenon means of said one handle means being adapted to fit in the first plurality of mortise means of another adjacent handle means and wherein the mortise means is located between the plurality of second tenon means on said opposite side.

2. A stamp as defined in claim 1, wherein the first non-porous layer is lined with a rubber cushion so that the rubber letter or figure is placed on the non-porous lining.

3. A stamp as defined in claim 1, wherein each handle means has a widened portion on each of the opposite sides, and wherein the first and plurality of second tenons means and the first and plurality of second mortise means are provided in the widened portion of the respective sides of each handle means.

4. A stamp as defined in claim 1, wherein the first tenon means and the second plurality of tenon means on the one and opposite sides of each handle means, each project outwardly from the one and opposite sides to provide for connecting two adjacent handle means by sliding an end of the projecting tenon or plural tenon means along a side of an adjacent handle means until the projecting tenon or plurality of tenon means on one handle means engages in alignment with the respective mortise or plural mortise means on an adjacent handle means, which alignment occurs when the plurality of projecting tenon means of one handle means has inserted therebetween the projecting tenon means of an adjacent handle means and the adjacent handle means can be pushed together to have the sides between them in contact.

* * * * *